US006290105B1

(12) United States Patent
Cosentino

(10) Patent No.: US 6,290,105 B1
(45) Date of Patent: Sep. 18, 2001

(54) VARIABLE VOLUME STORAGE DEVICE

(76) Inventor: John Cosentino, 10330 Talleysville Rd., New Kent, VA (US) 23124

( * ) Notice: Subject to any disclaimer, the term of this patent is extended or adjusted under 35 U.S.C. 154(b) by 0 days.

(21) Appl. No.: 09/435,689

(22) Filed: Nov. 8, 1999

(51) Int. Cl.[7] ..... B67D 5/00
(52) U.S. Cl. ..... 222/387; 222/386
(58) Field of Search ..... 222/383.1, 383.3, 222/385, 386, 387, 389

(56) References Cited

U.S. PATENT DOCUMENTS

| | | | | |
|---|---|---|---|---|
| 33,637 | * | 11/1861 | Dungan | 222/387 |
| 523,951 | * | 7/1894 | Van Fleet | 222/389 |
| 1,699,873 | * | 1/1929 | Brodsky | 222/286 |
| 1,714,482 | * | 5/1929 | Schmuziger | 222/386 |
| 2,341,031 | * | 2/1944 | Flynn | 222/387 |
| 2,557,952 | * | 6/1951 | Dumont | 222/387 |
| 3,362,589 | * | 1/1968 | Kinnavy et al. | 222/389 |
| 3,578,467 | | 5/1971 | Huber | 99/182 |
| 3,784,051 | | 1/1974 | Shaw et al. | 220/93 |
| 3,804,635 | | 4/1974 | Weber | 99/283 |
| 3,987,941 | | 10/1976 | Blessing | 222/386 |
| 4,169,671 | | 10/1979 | Culler | 396/598 |
| 4,620,794 | * | 11/1986 | Leka | 22/387 |
| 4,644,807 | * | 2/1987 | Mar | 222/387 |
| 4,723,674 | | 2/1988 | Nunes | 215/231 |
| 4,759,461 | | 7/1988 | Sharples et al. | 220/578 |
| 4,790,458 | * | 12/1988 | Moore | 222/386 |
| 4,951,848 | * | 8/1990 | Keller | 222/386 |
| 5,882,691 | * | 3/1999 | Conboy | 222/389 |
| 5,957,338 | * | 9/1999 | Lohmann | 222/387 |

* cited by examiner

*Primary Examiner*—J. Casimer Jacyna

(57) ABSTRACT

A variable volume storage device capable of eliminating or controlling contact between the contents and the atmosphere outside the device, designed so as to simultaneously prevent contact between the stored contents and any undesirable manufacturing materials used in the construction of the device by the entrapment of air pockets. This device is capable of functioning with any volume within its capacity, is easy to use, clean, and reuse, is simple in its operation, and allows the user full discretion in its application.

6 Claims, 3 Drawing Sheets

Fig 1
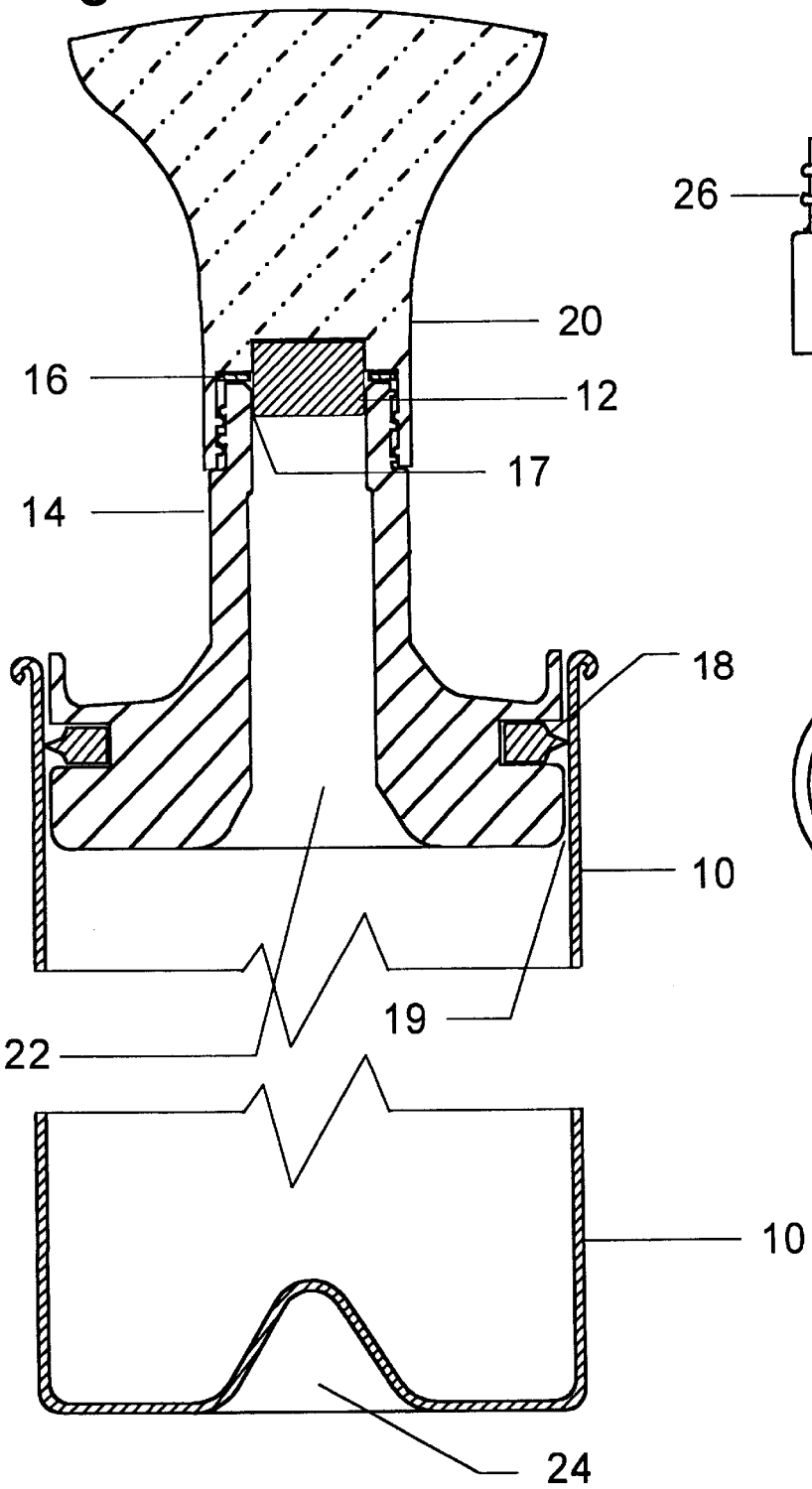
Fig 2-A
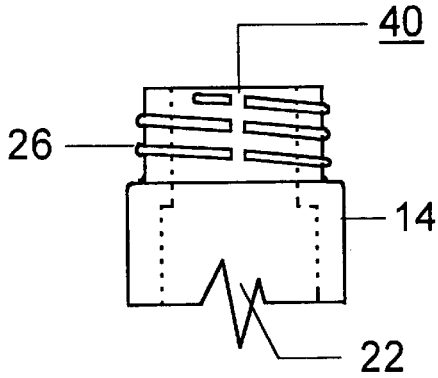
Fig 2-B
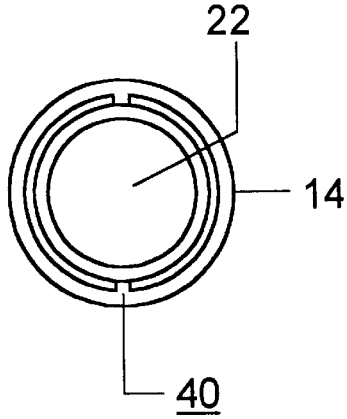

36
34
30
32
28
38
16
26
17
14
22

VARIABLE VOLUME STORAGE DEVICE

CROSS REFERENCE TO RELATED APPLICATION

Not Applicable

BACKGROUND—FIELD OF INVENTION

This invention relates to adjustable volume containers, including containers for the storage and preservation of consumable liquid products which require isolation from the air and other elements to prevent undesirable chemical reactions.

BACKGROUND—DESCRIPTION OF PRIOR ART

In the storage of many items, liquid, solid and gas, the problem of isolating the item from contact with the gases in the surrounding atmosphere has been an ongoing battle. In the case of an open bottle of wine, for example, degradation due to oxidation begins almost immediately and is able to quickly alter, and at last ruin, the highly prized qualities for which the product was purchased.

Several arrangements are sited in prior art to deal with this situation. As it applies to flowable food items, U.S. Pat. No. 3,784,051 issued to Shaw on Jan. 8, 1974, U.S. Pat. No. 3,987,941 issued to Blessing on Oct. 26, 1976, and U.S. Pat. No. 4,723,674 issued to Nunes on Feb. 9, 1988 describe systems which will isolate stored products within a container from the atmosphere without. These patents show movable follower lids inserted into a container able to adjust to changes in volume due to dispensing, whether by removing the lid and serving, or by dispensing from a tap at the bottom.

These inventions are designed for short term storage and have limitations confining them to that purpose. More importantly, these inventions present a solution to only part of the problem. Many food items and other products can be degraded simply by being in contact with commonly accepted materials such as plastic, rubber, leather or others. Rubberizer and plasticiser compounds and other agents can leach into the stored products and alter their properties and flavors. In dealing with substances such as wine, which is subject to the incredibly sensitive inspection by the wine consumer, finding a system which sufficiently satisfies these needs has proved elusive.

Some additional inventions and methods devised to accomplish this task for use with wine have included:

Using a vacuum pump to evacuate the gases present in the products original container. This has proved somewhat effective in reducing oxidation, but has faults of its own. The vacuum created in the vessel tends to liberate volatile components of certain products, such as esters from wine. This effect makes this system less than desirable.

Transferring the wine to a smaller vessel which the wine will fill completely and seal that vessel, or keep on hand a collection of glass marbles so that when a vessel is not full, one could wash these marbles and drop them into the vessel until the air void is displaced by the rising fluid, then reseal that vessel. The fact that these methods are hardly ever used, especially in the food service industry, attests to its impracticality.

Until now, the best options in the minds of most wine connoisseurs has been to drink the whole bottle within hours of its being opened, or reserve the unused wine, as expensive as it may have been, for use in cooking. The reason being all of the heretofore known inventions suffer several disadvantages:

(a) The products are manufactured using materials which are deemed unacceptable to the consumer because they react with, or are perceived as reacting with, the stored contents.

(b) They are not convenient enough to use on a regular basis. This inhibits there acceptance as a system for daily use, such as food service situations, where many containers of products may be reduced in volume and stored again over and over each day.

(c) These systems do not satisfy the sensitivities of the consumer.

SUMMARY

A variable volume storage device for fragile fluids such as wine, comprising a container, a closure which is movable linearly within the container, and a sealable orifice. Those surfaces which come into direct contact with the contents are made of an inert material suitable for storing contents without adulteration such as, but not limited to, glass or stainless steel. Those materials necessary for creating hermetic seals are positioned so as not to come in direct contact with the contents. Isolation of these materials is accomplished by using there sealing abilities to simultaneously encapsulate tiny amounts of air into pockets. These air pockets act as buffers to isolate the contents from the seal materials.

OBJECTS AND ADVANTAGES

Accordingly, several objects and advantages of my variable volume storage device are to solve the problem of:

(a) Storing constantly varying volumes of materials, such as the unused contents of a open bottle of wine or other products, while restricting contact between these materials and perceive undesirable or reactive elements.

(b) Storing these materials in an easy and convenient manner.

(c) Appealing to the needs and sensitivities of the typical consumer of fine wines and other products.

Further advantages are that this variable volume containers design is both easy and affordable to manufacture, is of a simple design and requires little instruction in its use. Still further objects and advantages will become apparent from a consideration of the ensuing description and accompanying drawings.

DRAWING FIGURES

FIG. 1 shows a cross-sectional view of the preferred embodiment of this invention.

FIG. 2-A is a partial non-sectional view from the front of the invention in FIG. 1, showing the orifice threads and a one possible air bleed groove arrangement.

FIG. 2-B is a partial non-sectional view from the top of the invention in FIG. 1, showing the orifice and air bleed groove arrangement.

REFERENCE NUMERALS IN DRAWINGS

| | |
|---|---|
| 10-container | 12-splash guard |
| 14-cover | 16-lip ring |
| 17-splash guard air pocket | 18-peripheral seal |
| 19-cover air pocket | 20-threaded cap |
| 22-cover orifice | 24-protrusion |
| 26-orifice threads | 28-dispensing cap assembly |
| 30-ball valve assembly | 32-valve actuator assembly |
| 34-coupling | 36-dispensing tube |
| 38-dispensing splash-guard | 40-air bleed groove |

DESCRIPTION—CURRENT PREFERRED EMBODIMENT OF THE INVENTION

Figure 4:
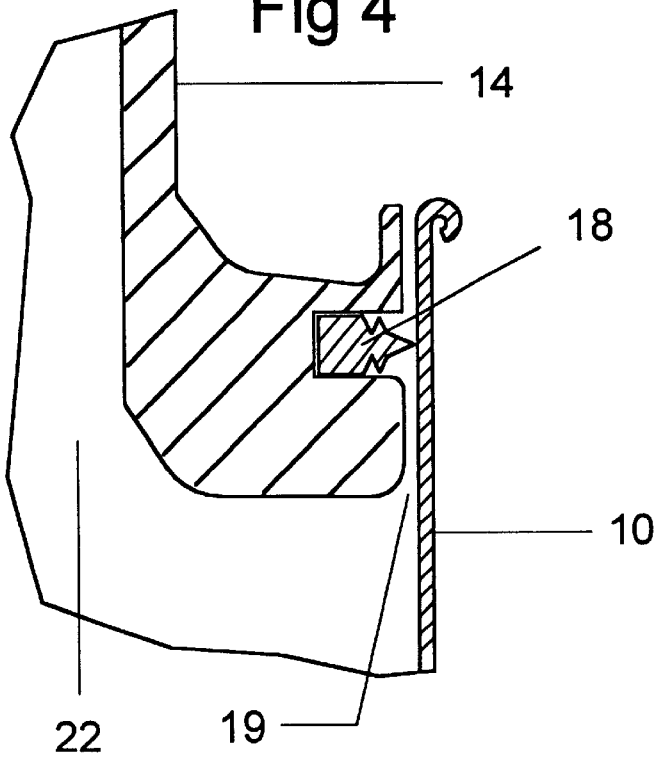
FIG. 4 is an enlarged partial view of FIG. 1 showing the area where the air pocket is formed by the cover.
Figure 5:
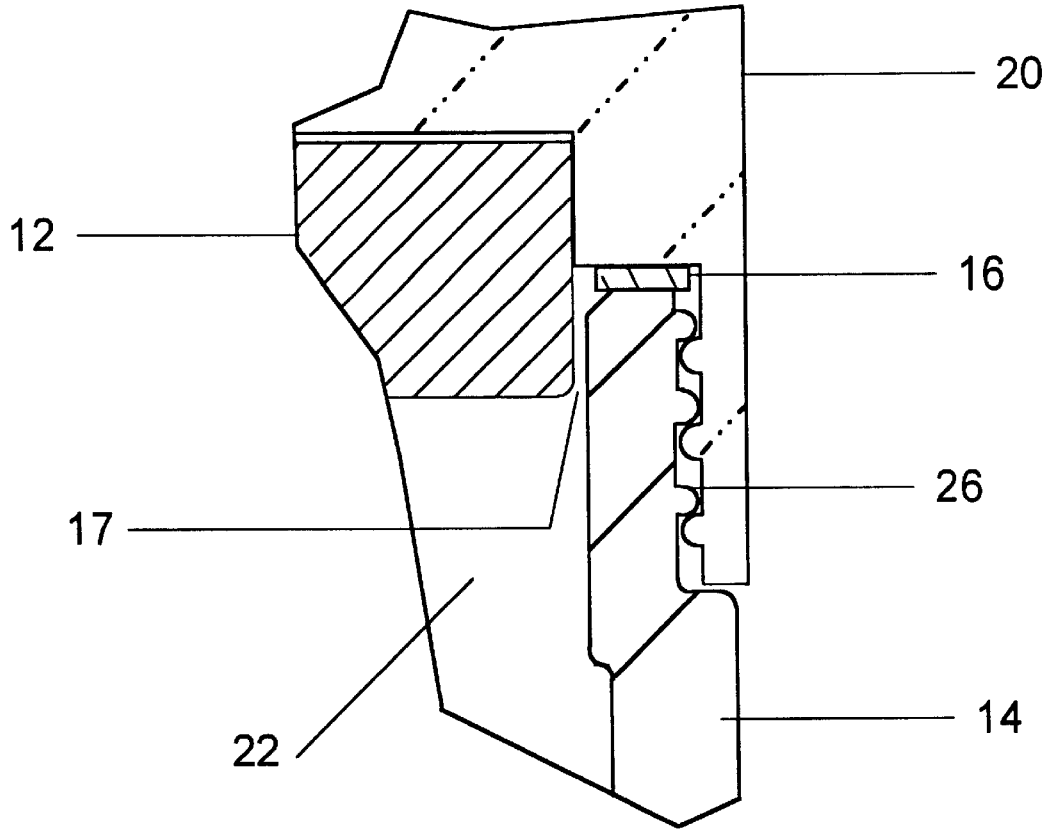
FIG. 5 is an enlarged partial view of FIG. 1 depicting the orifice and cap in the fully closed position, showing where the air pocket is formed by the splash guard.

The storage device presented in FIG. 1 is comprised of a container 10, which has straight sides, and a cover 14. Both of these components are made of an acceptably inert material, such as stainless steel or glass, or other suitable materials. The preferred embodiment of container 10 is a cylindrical form, but any shape may be used if it is uniform along its length. Cover 14 fits inside container 10 and has a seal 18 at its periphery. FIG. 4 shows how these three components combine to create the chamber which traps a cover air pocket 19. FIG. 1 shows that cover 14 has an integral orifice 22 and a means of sealing it. All the drawing figures show views of orifice threads 26 for this purpose. FIG. 1 shows that container 10 has one closed end which has an inward protrusion 24 that mates with orifice 22. In this embodiment, orifice threads 26 mate with a cap 20. The orifice threads 26 may have one or more integral air bleed grooves 40 shown in FIG. 2-A and FIG. 2-B. FIG. 1 shows that cap 20 has a splash guard 12, which is made of a suitably inert material. Splash guard 12 is fitted inside cap 20 and extends out from the center of its sealing face where it overlaps orifice 22. There is also a flexible lip seal 16 installed in cap 20 against this same sealing face. FIG. 5 shows how the splash guard 12, orifice 22 and lip seal 16 combine to create splash guard air pocket 17.

Figure 3:
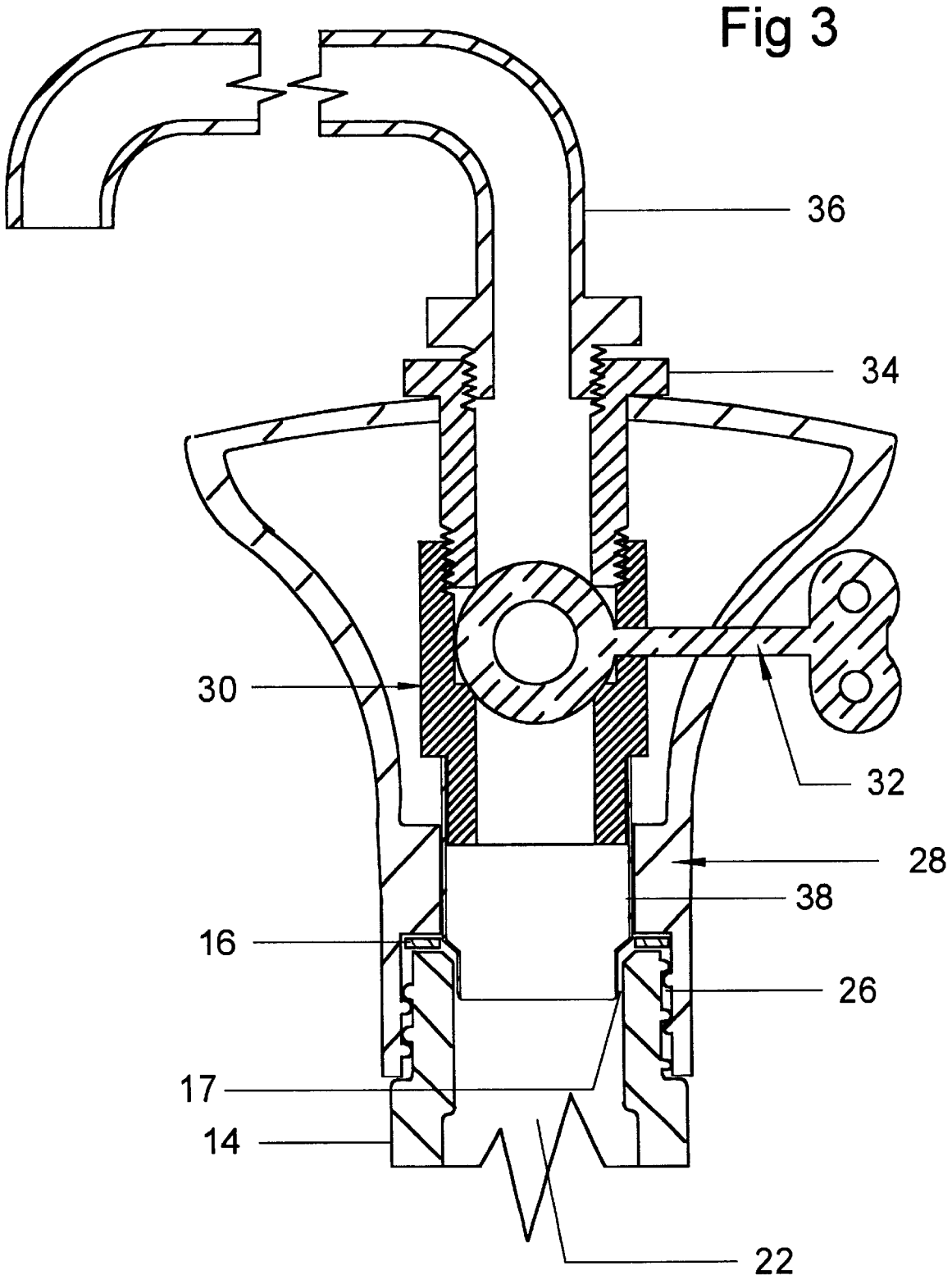
FIG. 3 Shows a enlarged cross-sectional view of a dispensing cap for the variable volume container, including a dispensing tube and valve assembly.

FIG. 3 shows the preferred embodiment of a dispensing cap assembly 28, wherein it is fitted with sealable conduit shown as a ball valve assembly 30. A hollow dispensing splash-guard 38 is made from a suitably inert material. A valve actuator assembly 32 is attached to ball valve assembly 30. A dispensing tube 36 is removably fastened to ball valve assembly 30 by means of a coupling 34.

Other Embodiments of the Invention

Alternative embodiments may be developed utilizing these same features. Dispensing may be done by way of a valve or tap near the bottom of container 10. The contents may also be removed under pressure by way of introducing compressed gas, weighing cover 14 to compress the contents, or by means of a pump. In cases where the size of container 10 increases, these features would be easily and advantageously incorporated into the previously described invention.

An additional embodiment may employ a self-sealing plug as a cap for orifice 22. A stainless steel plug with a tapered pipe thread or a threaded plug with an outwardly tapered shoulder could be used as well as many other configurations. Orifice 22 may also be directly connected to other dispensing or processing apparatus.

Advantages

From the description above, a number of the advantages to my invention become evident:

(a) The design lends itself to alteration of size and shape so as to be adaptable to applications in many different industries and markets.

(b) This storage device can be incorporated into existing systems as a holding cell for short or long term storage.

(c) The variety of methods of filling, sealing, and dispensing the contents stored within my variable volume storage device make it useful in automated systems as well as being suited to manual operation, or both at one time.

Operation

In function, the stored product is placed inside (FIG. 1) container 10. Cover 14 is inserted into container 10 with orifice 22 unstopped. Cover 14 is then pushed down into container 10. This causes peripheral seal 18 to come into direct contact with the inner wall of container 10. The internal atmosphere is pressurize by this movement, and is permitted to escape through orifice 22. Cap 20 may be loosely installed at this time to aid in handling cover 14. The internal atmosphere would then escape passed loosely fitting (FIG. 2-A and FIG. 2-B) orifice threads 26. Additional aid in permitting the atmosphere to escape is provided by air bleed grove 40. The gaseous atmosphere may thus be fully displaced. An amount of atmosphere may alternately be permitted to remain between the contents and the mouth of orifice 22 at the users discretion. Cap 20 (FIG. 1) is then installed and tightened over orifice 22 by means of mating threads. This action positions the elongated segment of splash guard 12 into orifice 22. Splash guard 12 may simply rest inside of orifice 22, or come into contact with orifice 22 at its rim as shown by dispensing splash guard 38 (FIG. 3). It may alternately be held in contact with orifice 22 under tension. At the same time an elastomeric, flexible lip ring 16 is compressed between the rim face of orifice 22 and the opposite overlaying surface of cap 20. This creates a airtight seal capable of preventing further atmospheric exchange. The amount of atmospheric gases the contents are exposed to for the duration of its storage time are thereby controlled.

Peripheral seal 18 is mounted to cover 14 and is made of a flexible elastomeric material. As cover 14 is pushed into the container, the compression and downward forces act on seal 18. This causes seal 18 to deform to the juxtaposed surface and create an hermetic seal. The result is that seal 18 now creates a cover air pocket 19 (FIG. 4) between itself and the contents. This is done by trapping air in the small clearance gap between the inner wall of container 10 and outer peripheral wall of cover 14. The contents cannot displace this trapped air. Cover air pocket 19 inhibits wetting engagement between the contents and seal 18. The seal is positioned a predetermined distance up the peripheral wall of cover 14. This location is away from the stored contents and determines the air pocket volume. The distance must be sufficient to prevent head pressure from compressing the contents into the gap between container 10 and cover 14. The position of seal 18 would vary according to the surface tension of the contents, head pressure, and the need to overcome capillary action. The exact dimensions would therefor be specific to each application and can be obtained by calculation or testing.

Cap 20 (FIG. 1) makes use of a flexible elastomeric material in lip ring 16 to make it airtight. The function of splash guard 12 is to inhibit wetting engagement between the contents and lip ring 16. This is accomplished in the same manner as stated above. By the entrapment of a splash guard air pocket 17 (FIG. 5) created by lip ring 16, and bound annularly by orifice 22 and splash guard 12 or dispensing splash guard 38.

To dispense the contents, (FIG. 1) simply loosen cap 20. Then draw cover 14 up using cap 20 as a handle if needed. Air will bleed into the container passed cap 20 by way of air bleed groove 40, and loosely fitted orifice threads 26. Cover 14 can be completely removed and the contents poured from the open container 10. Cover 14 can optionally be drawn up until integral orifice 22 extends beyond container 10. Then cap 20 may be completely removed and the contents decanted through the open orifice 22.

Dispensing cap assembly 28 (FIG. 3) depicts the preferred embodiment of a system to decant the contents without removing cap 20. Dispensing tube 36 is removably attached to ball valve assembly 30 which is fixed to dispensing splash guard 38. By applying downward pressure on cover 14, the contents are forced out through hollow dispensing splash guard 38 under minimal pressure. The contents then pass through the ball valve assembly 30 if it is open. Ball valve assembly 30 is activated using valve actuator assembly 32. The contents may then pass through coupling 34 and into dispensing tube 36. Dispensing tube 36 is curved and extends latterly beyond container 10. It is also long enough to extend beyond container 10 even when cover 14 is fully inserted. This allows the user to fill a glass or other suitable container without removing cover 14. This further minimizes exposure to the atmosphere and peripheral seal 18. Dispensing tube 36 may be is removable at coupling 34 as an aid to cleaning and storage.

As cover 14 reaches the bottom of the container, protrusion 24 enters into orifice 22. Protrusion 24 displaces the volume of orifice 22. This permits the invention to be effectively utilized with even a very small volume of stored contents.

The result of this method is an effective regulation of exposure between the contents and any reactive elements. This is accomplished by containing the stored product in a chamber free of reactive elements. Those materials which may be perceived as potentially reactive and are used in the construction of the invention are isolated from direct contact with the contents. This invention can be adjusted to be almost completely free of air. It also gives the consumer From here, it can be bled off. The contents will then be in wetting engagement with seal 18 and lip seal 16. This may be done at the users discretion.

This storage device can also be used to allow a predetermined amount of air access to the contents. In the case of wine, this will allow it to "breath", or oxidize, under a controlled environment.

Conclusion, Ramifications, and Scope

Accordingly, it can be seen that this invention describes in detail a device capable of being adjusted to accommodate infinite variations in the volume of contents stored within it. It also protects those contents from chemical exchange with undesirable elements whether they be in gaseous, liquid, or solid form. This invention also allows the consumer to alter the use this device as they see that the circumstances dictate. In addition, this device is designed to be reusable, easy to use and clean, as well as to be attractive, and appeal to the sensitivities of the consumer. Although the description above contains many specificities, these should not be construed as limiting the scope of the invention, but merely providing illustration of some of the presently preferred embodiments of this invention. Various other embodiments and ramifications are possible within its scope. For example, these same advantages could be incorporated into a device for storing gases or solid materials, or the device could be greatly enlarged or reduced in size and altered in shape. This invention can also be used in conjunction with other technology such as an induced atmosphere, pressure or vacuum systems, as well as facilitate additional dispensing technology. This invention is presented as a stand alone device, but could be incorporated as a component in other systems. Thus the scope of the invention should be determined by the appended claims and their legal equivalents, rather than by the examples given.

I claim:

1. A variable volume container, comprising:

a bottom;

an inner wall;

a fitted closure, movable linearly along an inner surface of said inner wall while maintaining a contact with said inner surface by way of a peripheral sealer sufficient to create and maintain a hermetic seal, said closure having a sealable orifice with at least two configurations, a first configuration enabling a free flow in and out of said container, and a second configuration creating said hermetic seal, wherein the closure is positionable at a position so as to displace gaseous contents from said container while entrapping a gaseous pocket between said contents and said sealer so as to remove said sealer from wetting engagement with the stored contents, said gaseous pocket being bound annularly by said inner wall.

2. The container recited in claim 1, wherein components of said container which come into wetting engagement with said contents are comprised from fundamentally inert materials.

3. The container recited in claim 1, wherein said cover is comprised of a transparent material whereby said contents may be visible as it comes into contact with said cover.

4. The container recited in claim 1, further comprising a threaded cap suitable for overlapping the orifice, the cap having an elongated retainer insertable into said orifice, and projecting outwardly from the overlapping contact surface of said cap so as to be enveloped by said orifice when said cap engages it, and a sealing means capable of creating a hermetic seal mounted upon said overlapping contact surface.

5. The container recited in claim 4 wherein said threaded cap retainer has an integral dispensing conduit and a sealable orifice, said retaining means being housed within, and passing through said cap, whereby contents captured by said cap may periodically be made to pass through it without requiring the removal of said cap.

6. The container recited in claim 4 wherein said threated cap retainer is composed of a fundamentally inert material not limited to, glass and stainless steel.

* * * * *